United States Patent [19]

Honda

[11] Patent Number: 4,535,733

[45] Date of Patent: Aug. 20, 1985

[54] VARIABLE VALVE TIMING APPARATUS

[75] Inventor: Shoichi Honda, Tokyo, Japan

[73] Assignee: Honda Giken Kogyo Kabushiki Kaisha, Tokyo, Japan

[21] Appl. No.: 700,327

[22] Filed: Feb. 12, 1985

Related U.S. Application Data

[63] Continuation of Ser. No. 376,090, May 7, 1982, abandoned.

[30] Foreign Application Priority Data

| | | | |
|---|---|---|---|
| May 15, 1981 | [JP] | Japan | 56-72158 |
| May 15, 1981 | [JP] | Japan | 56-72159 |
| Jun. 22, 1981 | [JP] | Japan | 56-95263 |
| Jun. 22, 1981 | [JP] | Japan | 56-95264 |

[51] Int. Cl.[3] ..... F01L 1/34

[52] U.S. Cl. ..... 123/90.17; 123/90.44

[58] Field of Search ..... 123/90.16, 90.17, 90.44, 123/90.15, 90.27

[56] References Cited

U.S. PATENT DOCUMENTS

| | | | |
|---|---|---|---|
| 1,527,456 | 2/1925 | Woydt et al. | 123/90.17 X |
| 3,313,280 | 4/1967 | Arutunoff et al. | 123/90.44 X |
| 4,267,811 | 5/1981 | Springer | 123/90.27 X |
| 4,354,460 | 10/1982 | Mae et al. | 123/90.16 |

*Primary Examiner*—William R. Cline
*Assistant Examiner*—Peggy A. Neils
*Attorney, Agent, or Firm*—Sughrue, Mion, Zinn, Macpeak and Seas

[57] ABSTRACT

An apparatus for varying valve timing for use in an four-cycle internal combustion engine having two camshafts. These camshafts are juxtaposed on a common camshaft holder supported within a cylinder head. Each of the camshafts mounts thereon at least one cam adapted to slidingly contact with a rocker arm. The apparatus is provided with a means for selectively urging said rocker arm by the selective actuation of the cams between two camshafts.

9 Claims, 9 Drawing Figures

VARIABLE VALVE TIMING APPARATUS

This application is a continuation, of application Ser. No. 376,090, filed May 7, 1982 now abandoned.

BACKGROUND OF THE INVENTION

The present invention relates to a variable valve timing apparatus for use in a four-cycle internal combustion engine, and more particularly, to a type thereof capable of selectively shifting valve timing between low speed and high speed regions.

According to a conventional valve timing apparatus, a rocker arm disposed between a camshaft and an intake or exhaust valve has a shiftable pivot point to alter valve timing. Alternatively, a plurality of rocker arms are provided to selectively actuate one of them to change valve timing. In both cases, the resultant structures become complicated and complex.

Further, the rocker arm is normally provided with a means for adjusting a tappet clearance such as an adjusting screw. With this construction, the position of the adjusting means may determine the length of the rocker arm. Therefore, suitable positional relationship between the rocker arm and the adjusting means has been investigated. Sometimes, the position of the adjusting means causes the length of the rocker arm to be long, so that compact and light-weight structure may not be obtainable.

SUMMARY OF THE INVENTION

It is therefore, an object of this invention to overcome the above-mentioned drawbacks and to provide an improved variable valve timing apparatus.

Another object of the invention is to provide such apparatus capable of providing a simple and compact structure.

Still another object of the invention is to provide such apparatus incorporating a means for further controlling valve timing at high speed running of a vehicle.

These and other objects of the invention will be attained in accordance with the present invention by providing a pair of camshafts juxtaposed on a common camshaft holder. Each of the camshafts has one end provided with a gear, and each of the gears are in meshing engagement with each other. One of the camshaft has a longitudinal extension connected to a shaft drive means. The camshaft integrally mounts thereon at least one cam for low speed, and the other camshaft integrally mounts thereon at least one cam for high speed. With this construction, selective contact between a rocker arm and one of the cams between two cam shafts is attained by a selective actuation means.

According to a first embodiment of the invention, the camshaft holder is mounted stationary on a cylinder head, and the selective actuation means comprises a clutch means disposed between the other camshaft and the corresponding gear. The rocker arm has an upper surface adjacent to a pivot point thereof in contact with the low speed cam during clutch OFF state, while the rocker arm has an upper free end surface in contact with the high speed cam during clutch ON state.

According to a second embodiment of the invention, the camshaft holder is pivotally supported about the one of the camshafts, and the selective actuation means comprises a hollow shaft having one end integral with the holder and coaxial with the one of the camshafts, and having the other end connected to an upper end of an arm. The lower portion of the arm is connected to a horizontal rod. Upon movement of the horizontal rod, the arm pivots about the camshaft, to thus integrally rotate the camshaft holder. The movement of the rod provides first and second positions of the holder. The rocker arm has an upper surface adjacent to a pivot point thereof in contact with the low speed cam at the first position of the camshaft holder, and the rocker arm has an upper free end surface in contact with the high speed cam at the second position of the holder.

Further, according to the present invention, an arm control means is provided to control the pivotal position of the arm, to thus control the pivotal position of the camshaft holder. Furthermore, according to the second embodiment, two cams are integrally mounted on the other camshaft, and the rocker arm has a free end portion being subdivided into two splits to contact with the corresponding two cams. These cams provide a space therebetween to allow extension of a tapet clerance adjuster therethrough.

These and other object of the invention will become apparent from the description of the drawings and the preferred embodiments which follow.

DESCRIPTION OF THE PREFERRED EMBODIMENTS

A first embodiment of this invention is shown in FIGS. 1 to 4, wherein an intake or exhaust valve 1 in a four-cycle engine is opened and closed by a rocker arm 2 associated with the upper end of the valve 1, and a camshaft assembly 3 provided above the rocker arm 2. The camshaft assembly 3 comprises a camshaft **3*a* for low speed operation, and a camshaft 3*b* for high speed operation. The camshafts 3*a* and 3*b* are juxtaposed in a common camshaft holder 4 in a cylinder head, or other frame 5**.

Figure 3:
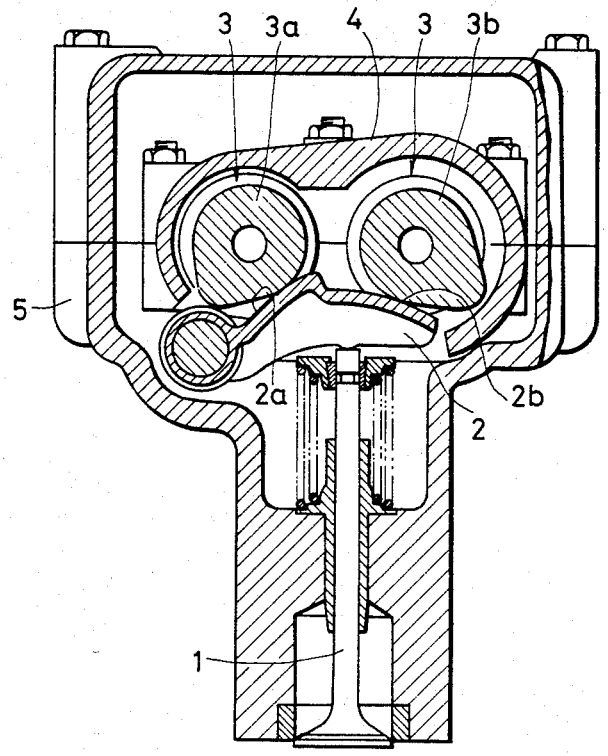
FIG. 3 is a sectional view taken along the line III—III of FIG. 2.

According to the first embodiment of this invention, the camshaft holder 4 is stationary instead of being tiltable; therefore, the camshafts **3*a* and 3*b* are always in engagement with the rocker arm 2. As shown in FIG. 3, the camshaft 3*a* for low speed operation is engaged with a slipper 2*a* defined by the upper surface of the rocker arm 2 adjacent to the base thereof, while the camshaft 3*b* for high speed operation is engaged with a slipper 2*b* defined by the upper surface of the rocker arm 2** adjacent to the free end thereof.

The camshafts **3*a* and 3*b* can be driven selectively. A gear 6 is connected to each of the camshafts 3*a* and 3*b*, and the gears 6 are engaged with each other so that the camshafts 3***a* and 3*b* may be rotated together. The camshaft 3*a* for low speed operation has a longitudinal extension which carries a cam sprocket 7 associated operationally with a crankshaft on the engine to drive the camshafts 3*a* and 3*b*. A clutch 8 is disposed between the camshaft 3*b* for high speed operation and the gear 6 provided thereon. If the clutch 8 is opened, only the camshaft 3*a* for low speed operation is driven, while the camshaft 3*b* for high speed operation is simultaneously driven if the clutch 8 is closed.

Figure 4:
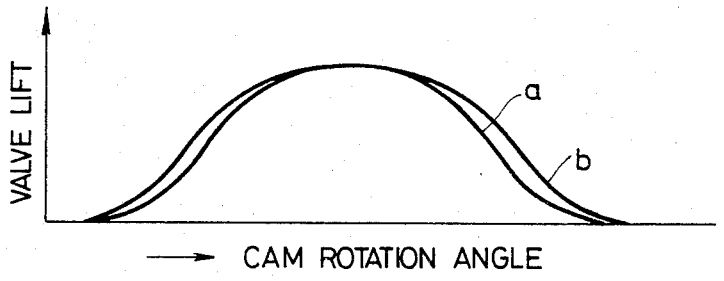
FIG. 4 is a diagram showing the operating characteristics of the apparatus shown in FIGS. 1 to 3.
Figure 5:
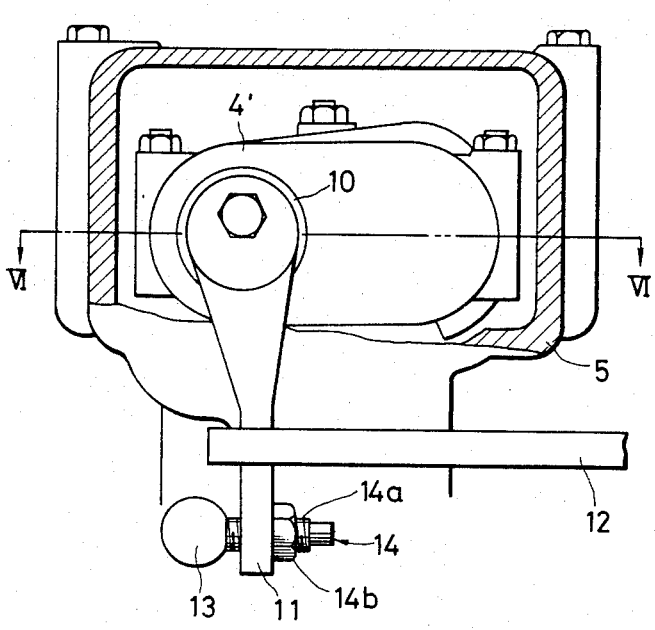
FIG. 5 is a front elevational view of the apparatus according to a second embodiment of this invention.

If the clutch 8 is opened, only the camshaft 3*a* for low speed operation is driven, and the valve 1 is opened and closed by the rocker arm 2 in accordance with a valve lift curve which is by way of example shown at a in FIG. 4. If the clutch 8 is closed, the camshaft 3*b* for high speed operation is also driven, and the valve 1 is opened and closed by the rocker arm 2 in accordance with a valve lift curve which is by way of example shown at b in FIG. 4.

According to the first embodiment of this invention, the necessary switchover of the valve operation can be effected only if the camshafts for low speed operation and for high speed operation are driven selectively by means of the clutch, and therefore, the valve can be actuated smoothly and accurately.

Figure 1:
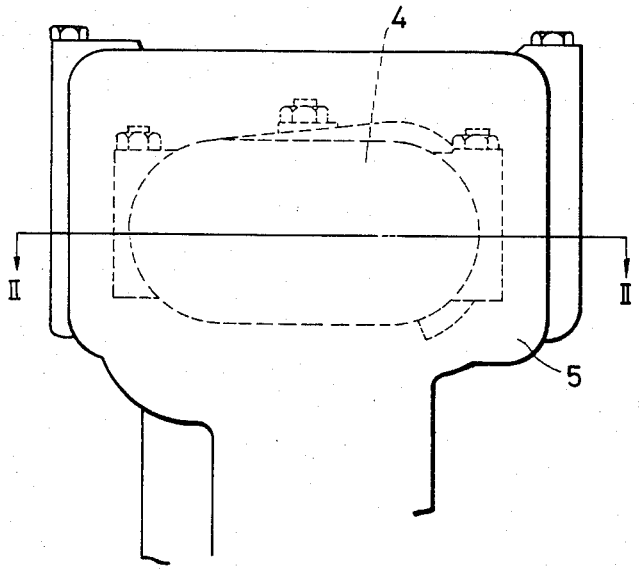
FIG. 1 is a front elevational view of the apparatus according to a first embodiment of this invention.
Figure 2:
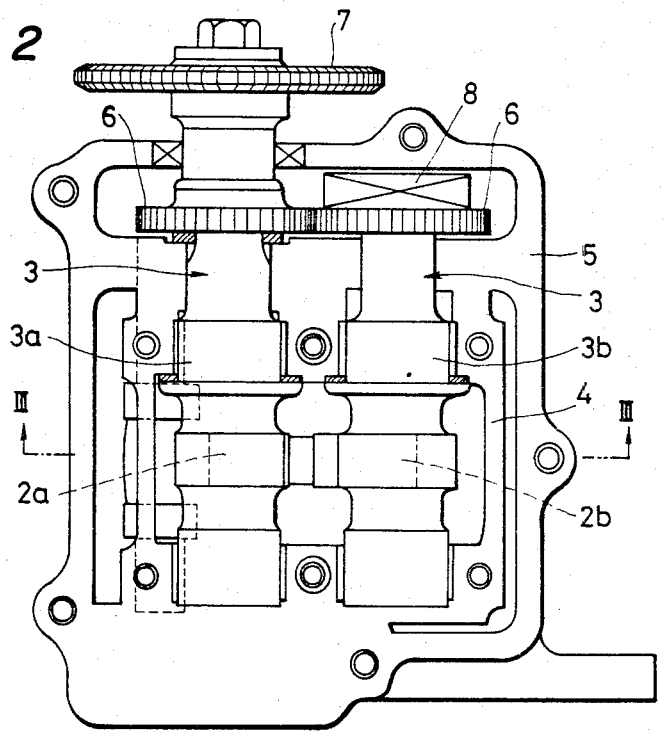
FIG. 2 is a sectional view taken along the line II—II of FIG. 1.

A second embodiment of this invention is shown in FIGS. 5 to 9 wherein like parts and components are designated by the same reference numerals and characters as those used in FIGS. 1 to 3. The second embodiment also includes a camshaft assembly 3 which comprises a camshaft 3*a* for low speed operation and a camshaft 3*b* for high speed operation, and a common camshaft holder 4' on which the camshafts 3*a* and 3*b* are juxtaposed. The holder 4' is supported on a cylinder head, or other frame 5, and is integral with a shaft 10 which is coaxial with and rotatable about the camshaft 3*a*. The camshafts 3*a* and 3*b* can be driven selectively by the pivotal movement of the holder 4'.

Figure 7:
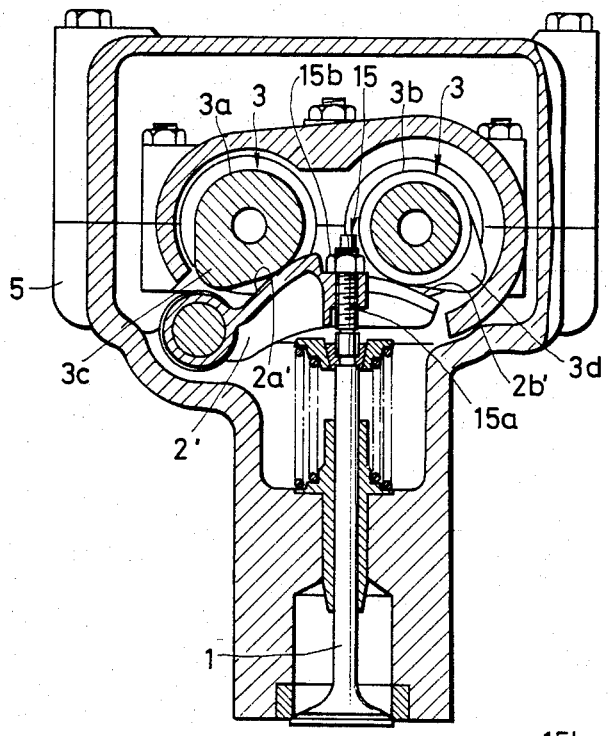
FIG. 7 is a sectional view taken along the line VII—VII of FIG. 6.
Figure 8:
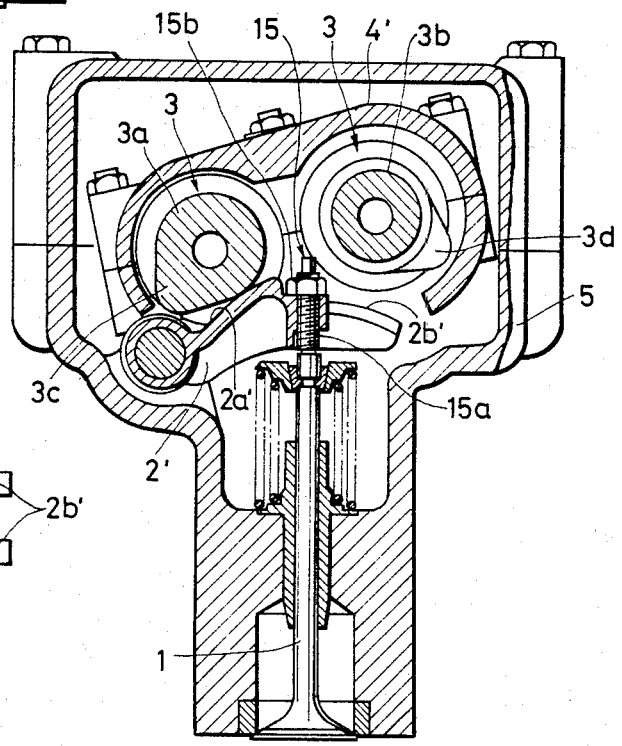
FIG. 8 is a view similar to FIG. 7, but showing the apparatus in a different position.

The camshaft 3*a* includes a cam projection 3*c* facing a slipper 2*a'* defined by the upper surface of a rocker arm 2' adjacent to the base or pivotal point thereof, while the camshaft 3*b* likewise includes a cam projection 3*d* facing a slipper 2*b'* defined by the upper surface of the rocker arm 2' adjacent to the free end thereof. The holder 4' is vertically pivotable about the camshaft 3*a*. If the holder 4' is moved upwardly, the cam projection 3*c* of the camshaft 3*a* engages the slipper 2*a'* of the rocker arm 2' to actuate the same as shown in FIG. 8. If the holder 4' is lowered, the cam projection 3*d* of the camshaft 3*b* engages the slipper 2*b'* of the rocker arm 2' to actuate the same as shown in FIG. 7.

The shaft 10 is integrally connected to a downwardly extending arm 11 to which a horizontally movable rod 12 is connected. A stop 13 is provided ahead of the arm 11 to restrict forward movement of the rod 12. If the rod 12 is moved horizontally, the arm 11 rotates the shaft 10 about the camshaft 3*a*, to thus rotate the holder 4'. An arm control device 14 is provided at the lower end of the arm 11 and confronting with the stop 13. The device 14 comprises an adjust screw 14*a* which is engagable with the stop 13, and a nut 14*b* on the screw 14*a*. The control device 14 serves to adjust the clearance between the camshaft assembly 3 and the rocker arm 2' to enable them to function smoothly. These arrangements ensure variable valve timing for the high speed operation of the engine.

Figure 6:
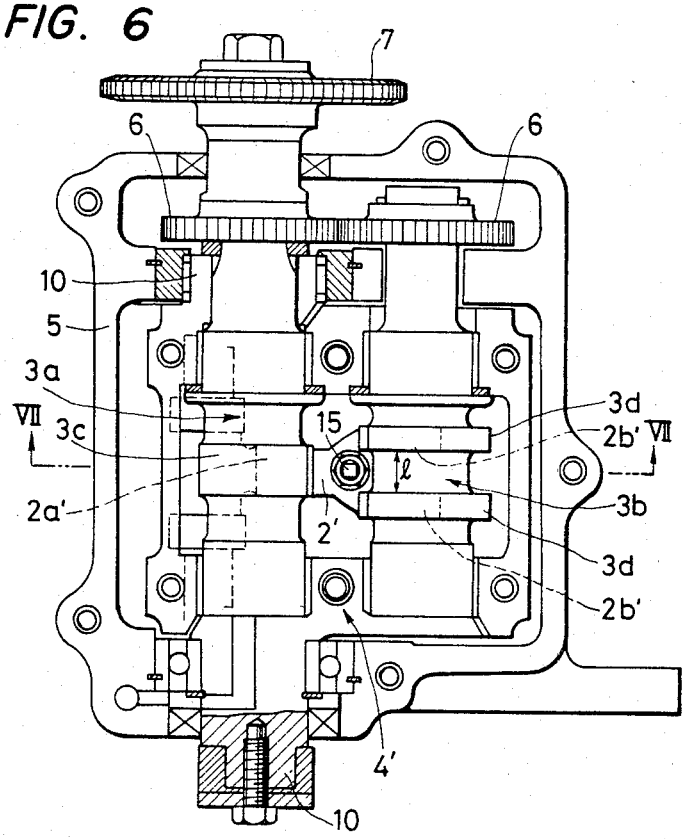
FIG. 6 is a sectional view taken along the line VI—VI of FIG. 5.
Figure 9:
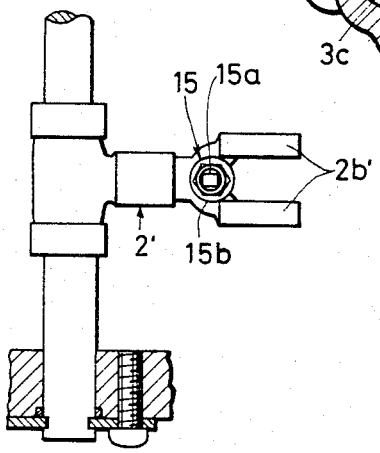
FIG. 9 is a top plan view of the rocker arm in the apparatus shown in FIGS. 5 to 8.

According to another aspect of the second embodiment of this invention, the cam projection 3*d* comprises at least two halves 3*d'* which are spaced apart from each other by an appropriate distance as indicated at l in FIG. 6, and the rocker arm 2' is provided with a clearance adjusting device 15 within the gap l. The device 15 comprises an adjust screw 15*a* extending downwardly through the rocker arm 2', and a nut 15*b* bearing against the rocker arm 2' adjacent to the upper end of the adjust screw 15*a*. The slipper 2*b'* comprises two split halves with which the split halves 3*d'* of the cam projection 3*d* are respectively engageable, as shown in FIGS. 6 and 9. The clearance adjusting device 15 is provided at a point where the split halves of the slipper 2*b'* meet each other. These arrangements permit control of the tappet clearance for the low speed operation of the engine.

The camshafts 3*a* and 3*b* effect a valve lift which is characterized as shown by way of example in FIG. 4. In FIG. 4, curve a shows a valve lift for the low speed operation, and curve b shows a valve lift for the high speed operation. The curves a and b are in the same phase, as is the case with the first embodiment of this invention.

When the engine is driven at a low speed, the camshaft holder 4' is in its upwardly tilted position as shown in FIG. 8. Only the camshaft 3*a* for the low speed operation of the engine is engaged with the rocker arm 2', so that the valve 1 may be actuated in accordance with curve a in FIG. 4. If it is desired to drive the engine at a high speed, the holder 4' is lowered as shown in FIGURE 7. The camshaft 3*b* is brought into engagement with the rocker arm 2' to actuate the valve 1 in accordance with the characteristics shown by curve b in FIG. 4. When the camshaft holder 4' is lowered to place the camshaft 3*b* in its operative position, the lowermost position of the holder 4' is defined by the stop 13, and can be adjusted by the control device 14, whereby the clearance between the rocker arm 2' and the camshaft assembly 3 is adjustable as required.

According to the second embodiment of this invention, the valve timing can be changed only by the pivotal movement of the holder. Therefore, the apparatus is very simple in construction, as it essentially comprises two camshafts juxtaposed on a common rotatable holder, and accordingly, eliminates the aforementioned drawbacks of the conventional apparatus. When the camshaft assembly is selectively brought into its operative position, the clearance between the rocker arm and the camshaft assembly is adjustable as required to ensure that they function smoothly. This adjustment is easy to achieve by the control device associated with the camshaft holder and the stop. The rocker arm can be of relatively small length, while the cam projection on one of the camshafts is divided into at least two appropriately spaced apart halves, and the clearance adjusting device is provided between those two halves. This contributes to reduction in size of the apparatus as a whole.

While the invention has been described in detail and with reference to specific embodiments thereof, it will be apparent for those skilled in the art that various changes and modifications can be made therein without departing from the scope and spirit of the invention.

What is claimed is:

1. A variable valve timing apparatus for use in a four-cycle internal combustion engine, said engine including intake and exhaust valves each operated by a rocker arm, comprising:

(a) a pair of camshafts extending in parallel with each other, one of said camshafts mounting thereon at least one cam for low speed operation, and the other camshaft mounting thereon at least one cam for high speed operation, (b) a camshaft holder for supporting said pair of camshafts, said camshaft holder being housed within a cylinder head, each of said camshafts having one end provided with a fixed gear, and said gears of said camshafts being in fixed meshing engagement with each other and being fixed against axial movement relative to each other, said one of said camshafts having an axial extension connected to a shaft drive means; and (c) means for selectively operating said rocker arm by the selective actuation of at least said high speed cam.

2. The apparatus of claim 1, wherein said camshaft holder is mounted stationarily.

3. The apparatus of claim 2, wherein said means for selective actuation comprises a clutch means adapted to selectively couple said other camshaft to said gear of said other camshaft.

4. The apparatus of claim 3, wherein said rocker arm has an upper surface in contact with said low speed cam at a position adjacent to a pivot point of said rocker arm during clutch release of said other high speed camshaft, and said rocker arm has an upper free end surface in contact with said high speed cam during coupling of said clutch.

5. The apparatus of claim 1, wherein said camshaft holder is pivotally supported about said one of said camshafts.

6. The apparatus of claim 5, wherein said means for selective actuation comprises a shaft provided coaxial with said one of camshafts, said shaft having one end integrally connected to said camshaft holder, an arm having one end integrally connected to the other end of said shaft, and a rod connected to the other end of said arm to pivot said camshaft holder via said arm and said shaft, the movement of said rod providing a first and second positions of said camshaft holder.

7. The apparatus of claim 6, wherein said rocker arm has an upper surface in contact with said low speed cam at a position adjacent to a pivot point of said rocker arm upon said camshaft holder being at said first position, and said rocker arm has an upper free end surface in contact with said high speed cam upon said camshaft holder being at said second position.

8. The apparatus of claim 6, further comprising an arm control means positioned adjacent to the other end of said arm, and a stop positioned in confrontation with said arm control means, said control means being adapted to control clearance between said cams and said rocker arm, and said stop being adapted to restrict forward movement of said arm.

9. The apparatus of claim 6, wherein two high speed cams are provided on said other camshaft, and said rocker arm has a free end being subdivided into two splits in contact with corresponding one of said two cams, said two cams providing a space therebetween to allow extension of a tappet clearance adjuster therethrough.

* * * * *